United States Patent [19]

Karttunen et al.

[11] 4,456,190

[45] Jun. 26, 1984

[54] ARRANGEMENT FOR WINDING OF WEBS

[75] Inventors: Martti Karttunen, Kellokoski; Heikki Niskanen; Hannu Oinonen, both of Järvenpää, all of Finland

[73] Assignee: Oy Wartsila Ab, Helsinki, Finland

[21] Appl. No.: 312,503

[22] Filed: Oct. 19, 1981

[30] Foreign Application Priority Data

Oct. 21, 1980 [FI] Finland ..... 803300

[51] Int. Cl.[3] ..... B65H 17/12; B65H 19/26

[52] U.S. Cl. ..... 242/56 R; 242/66

[58] Field of Search ..... 242/56 R, 66

[56] References Cited

U.S. PATENT DOCUMENTS

| | | | |
|---|---|---|---|
| 3,498,557 | 3/1970 | Ball | 242/56 R |
| 3,539,125 | 11/1970 | Patriksson | 242/56 R X |
| 3,841,578 | 10/1974 | Dorfel | 242/56 R |
| 4,183,474 | 1/1980 | Schonmeier | 242/66 |
| 4,304,368 | 12/1801 | Bartmann | 242/56 R |

*Primary Examiner*—John M. Jillions

*Attorney, Agent, or Firm*—McAulay, Fields, Fisher, Goldstein & Nissen

[57] ABSTRACT

An arrangement for winding a web, in particular a paper web, on a roll core or the like in a two-drum winder comprising two support drums and a rider roll surrounding the web core. The arrangement includes means for supplying, during the final stage of a roll winding process, a new roll core between the newly finished roll and the support drums. There are also a web cutter and means for the transfer of a finished roll away from the support drums. The front end of a transversely cut web is guided to form the beginning of a new roll around a new roll core by guiding means comprising a plurality of guiding units spaced-apart in the circumferential direction of the new roll core. These units include means for creating pneumatic jets urging the web tightly around the new core.

15 Claims, 4 Drawing Figures

ARRANGEMENT FOR WINDING OF WEBS

The invention relates to an arrangement for winding a web, in particular a paper web, on a roll core or the like in a two drum winder comprising two support drums and a rider roll surrounding said web core, said arrangement including means for supplying, during the final stage of a roll winding process, a new roll core between the finished roll and said support drums, a web cutter and means for the transfer of a finished roll away from said support drums.

It is known to wind a web in a two-drum winder on successive roll cores. After cutting the web, it is difficult to guide the web front end around a new roll core. Usually, the web end is simply attached to the new core. For this purpose glueing as well as stapling has been used. Both methods are, however, cumbersome, expensive and time-consuming.

The object of the invention is to provide a new winder arrangement, in which the starting of a winding process on a new roll core is uncomplicated and reliable. The invention is characterized in that the arrangement comprises means for guiding the web front end forming the beginning of a new roll around a new roll core, said means comprising a plurality of guiding units spaced-apart in the circumferential direction of a properly inserted roll core, said units including means for creating pneumatic jets for guiding the web tightly around said core. By applying a pneumatic medium for guiding the web, no separate attachment of the front end of the web to the roll core is needed.

In a preferred embodiment of the invention, the web front end guiding device comprises three guiding units. The first unit, preferably arranged adjacent to the web cutter, guides the web front end between the roll core and the rider roll. The second unit, preferably arranged adjacent to the rider roll, guides the web front end further in between the roll core and the first support drum. The third unit, located between, or arranged to be moved between, the two support drums, guides the web front end in between the roll core and the second support drum, whereby the web front end is compressed between the roll core and the next web layer wound around the core. After this initial phase, the web winding can proceed as usual in two-drum winders.

The operations of the web end guiding units can be synchronized on the basis of the function of any of the following devices: the first support drum, the second support drum, the rider roll, the web cutter, the transfer means for completed rolls. The synchronization can also be based on a combination of the functions of some of these devices. The object of the synchronization is to obtain automatic continuation of the roll winding process on a new roll core.

By controlling the power and the directions of the jets the guiding units can easily be adapted to suit different web materials, web speeds, roll core dimension and other varying winding parameters. The jet power acting on the web can be adjusted also by varying the distance between the jet and the web.

BRIEF DESCRIPTION OF THE DRAWINGS

In the following, the invention is described more in detail with reference to the attached drawings, in which FIGS. 1 to 4 schematically show successive phases of a roll core replacement operation.

In the drawing, reference numeral 1 indicates a web, which is wound around a roll core 6. The core of a complete roll 2 is indicated by **6*a* and a new roll core is indicated by 6*b*. The winding process is carried out in a conventional two-drum winder comprising a first support drum 3, a second support drum 4 and a rider roll 5**.

Figure 2:
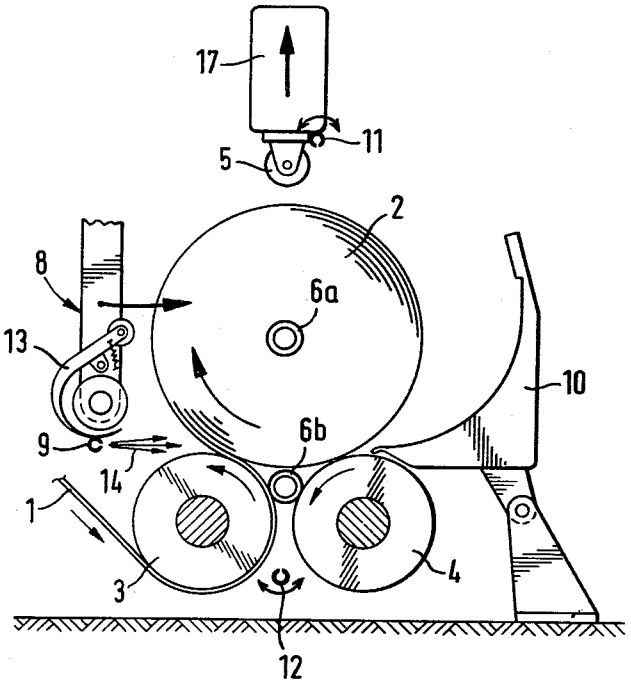
FIGS. 1 and 2 show how a new roll core **6*b* is brought in from the side of the winder by means of an insertion device 7 to a space between the support drums 3 and 4 and a complete roll 2. The roll core stock, usually located outside the winder, is not shown in the drawing. Naturally, the roll core 6*b* can as well be brought in between support drum 4 and paper roll 2 after lifting paper roll 2 by means known per se. It is also possible to bring in from below a new roll core 6*b* between support drums 3 and 4 to the position shown in FIG. 2. This requires that the distance between support drums 3 and 4** can be temporarily enlarged.
Figure 1:
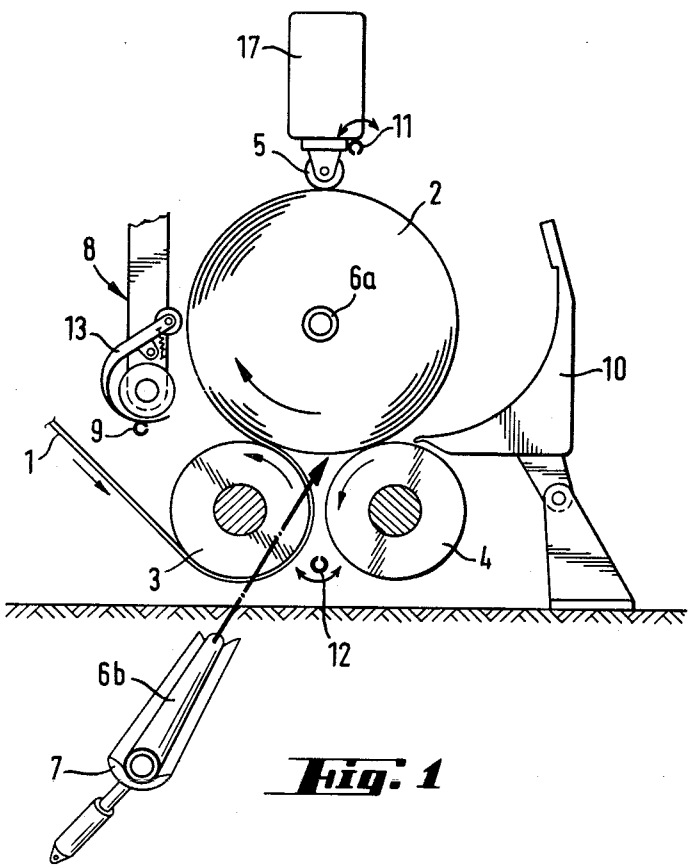
Figure 4:
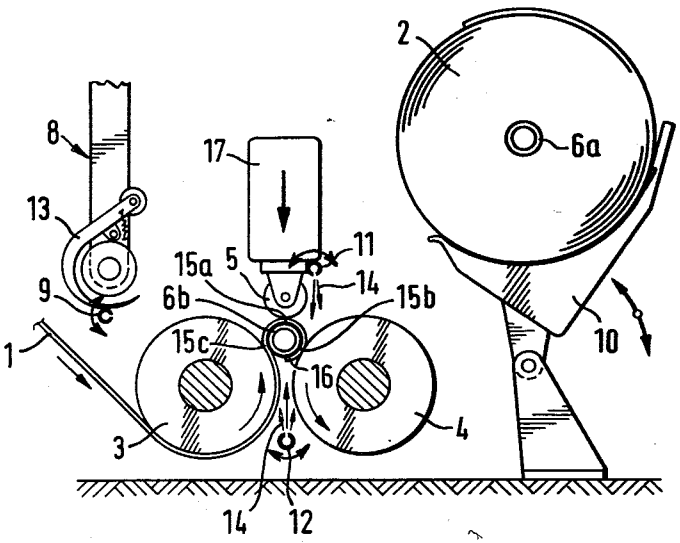
Figure 3:
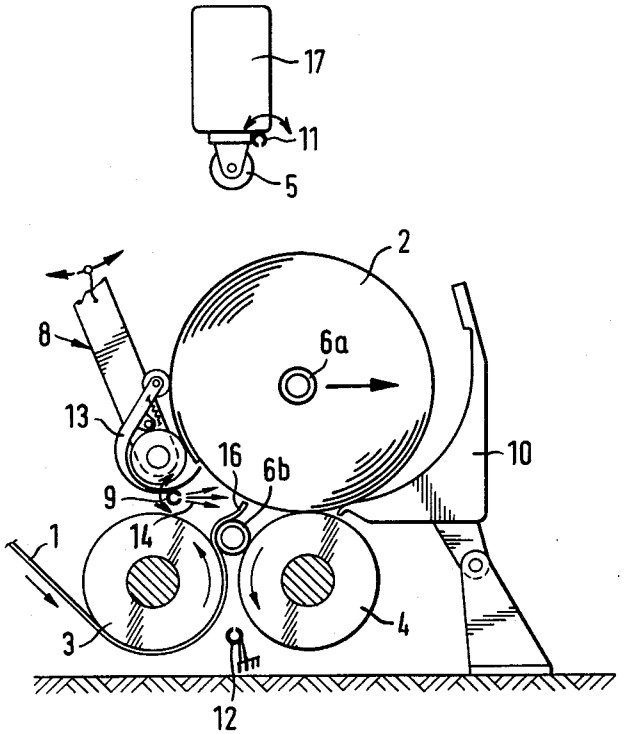
FIG. 3 shows how a roll pusher 8 moves a completed paper roll 2 over support drum 4 into a lowering device 10, which moves roll 2 out from the winder, as shown in FIG. 4. Roll pusher 8 includes a web cutter 13, which cuts web 1 simultaneously with the pushing action of pusher 8. A web guiding unit 9 is attached to pusher 8. It includes air jets 14 for guiding the front end of the web over a new roll core **6*b*. Simultaneously with the transfer of a completed paper roll 2 the rider 5 is lowered into contact with the new roll core 6*b* (FIG. 4). Web 1 is thereby compressed between roll core 6*b* and rider roll 5 in a nip 15*a*. It is obvious that the full-speed winding process has to be interrupted during roll core replacement between the moment of cutting web 1 and the moment of rider roll 5 contacting the web on new roll core 6*b*. After passing nip 15*a*, the web front end is urged by jets 14 of guiding unit 11 attached to rider roll support 17 in between core 6*b* and support drum 4 to a second nip 15*b*. Finally, the web front end is further urged by jets 14 of web guiding unit 12 in between core 6*b* and the following portion of the web to a third nip 15*c*. Thus, the web front end is compressed between roll core 6*b* and the next web layer to be wound around core 6*b*. Thereafter, no further guiding of the front end of the web is necessary and the winding process continues in its normal way. Web guiding unit 12 can be either stationary or basically vertically movable. It can be supported by, for instance, the machine frame (not shown) in which the support drums are journalled. The means for supporting and moving drums 3 and 4, roll 5 and roll pusher 8** are not shown in detail as they relate to known art.

The invention is not limited to the embodiments disclosed, but several modifications thereof are feasible within the scope of the attached claims.

We claim:

1. An arrangement for winding a web, in particular a paper web, onto a roll core or the like in a two drum winder comprising two support drums and a rider roll surrounding said roll core and means for leading said web from below up between said support drums, said arrangement including means for supplying, during the final stage of a roll winding process, a new roll core between the roll made in said process and said support drums, a web cutter for transverse cutting of said web at a position above said new roll core and means for the transfer of a finished roll away from said support drums, and arrangement further comprising means for guiding a front end of a transversely cut web to form the beginning of a new roll around said new roll core, said means comprising a plurality of guiding units spaced-apart in the circumferential direction of said new roll core, said units including means for creating pneumatic jets for guiding said web end tightly around said new roll core, one of said pneumatic jets being positioned in close relationship to said web cutter.

2. An arrangement according to claim 1, in which said guiding units comprise a first guiding unit adjacent to said web cutter for urging said web end in between said new roll core and said rider roll, a second guiding unit adjacent to said rider roll for urging said web end in between said new roll core and one of said support drums, and a third guiding unit located between said support drums for urging said web end in between said new roll core and the other of said support drums for completing the first winding layer of a new roll.

3. An arrangement according to claim 2, in which the functions of said guiding units are synchronized on the basis of one or several of the functions of the following devices: first support drum, second support drum, rider roll, web cutter and finished roll transfer means.

4. An arrangement according to claim 2 or 3, in which the power and the direction of the jets of said guiding units are adjustable.

5. An arrangement according to claim 2 in which said third guiding unit is supported by a body carrying said support drums.

6. An arrangement according to claim 1, including pusher means for moving the finished roll over one of said two support drums into a lowering device, said pusher means including said web cutter for simultaneously cutting the web with the pushing action of said pusher for moving the finished roll into said lowering device.

7. An arrangement according to claim 1, wherein said transfer means includes a pusher for moving a finished roll over one of said support drums into a lowering device, said pusher including said web cutter and one of said guiding units and moving said web cutter and said one guiding unit together.

8. An arrangement for winding a web onto a roll core, comprising:

first and second support drums and a rider roll defining a space therebetween for the roll core onto which the web is to be wound;

means to insert a new roll core into the space between the two support drums during a final stage of a roll winding process from a position beneath a roll made in the process;

means for leading said web from below said support drums up between said support drums in the space therebetween onto the roll core;

a web cutter for transverse cutting of the web at a position above the new roll core after insertion thereof between said support drums;

means for removal of the roll made in the process after cutting of the web by said web cutter; and a plurality of pneumatic guiding units for creating pneumatic jets to guide said web end tightly around the new roll core including a first guiding unit for guiding a front part of the transversely cut web onto the new roll core, after first guiding unit being coupled with said web cutter, a second guiding unit to wrap the cut web and move it between said second support drum and the new roll core to a position thereon between said support drums, and a third guiding unit to wrap the cut web and guide it between said first support drum and the new roll core to complete a first layer onto the new roll core.

9. The arrangement of claim 8, wherein said insertion means includes an insertion device for inserting the new roll core from a side of a said support drums therebetween and below said rider roll.

10. The arrangement of claim 8, wherein said guiding units are circumferentially placed about the new roll core after insertion thereof, and each of said guiding units includes jets directed towards the new roll core.

11. The arrangement of claim 9, wherein said guiding units are circumferentially placed about the new roll core after insertion thereof, and each of said guiding units includes jets directed towards the new roll core.

12. In an arrangement for winding a web onto a roll core in a two drum winder having two support drums and a rider roll surrounding the web core, the improvement comprising:

means for supplying a new roll core between a finished roll and the support drums from a position below said rider roll and from a side of said two support drums;

a web cutter for cutting the web of the finished roll above the new roll core, and pusher means coupled with said web cutter for removal of the fnished roll after cutting by said web cutter; and peripheral pneumatic guide means including a first guide positioned on said pusher means between one of said support drums and said rider roll, a second guide positioned between said support drums thereabove, and a third guide positioned between said pair of support drums therebelow, to provide successive pneumatic jets onto a leading web edge after it is cut by said web cutter from a previously completed wound web roll to cause the leading edge to be placed onto said new roll core after passing between a first of said two support drums and said new roll core, then moved between said rider roll and said new roll core to a position between a second of said two support drums and said new roll core, and between an incoming web portion on said first support drum and said new roll core and being held thereto solely by the continuously subsequently fed web from said first support drum.

13. In the arrangement of claim 12, wherein said three pneumatic guides are peripherally spaced about the circumferential surface of said new roll core for supplying an air jet onto the web for wrapping the first layer thereof onto said new roll core.

14. In the arrangement as claimed in claim 12, wherein said supplying means includes an insertion device positioned at a side of said first and said second support drums and below said rider roll for supplying said new roll core.

15. An arrangement according to claim 12, wherein said third guide is stationary relative to the support drums.

* * * * *